US007013631B2

(12) United States Patent
Carrola

(10) Patent No.: US 7,013,631 B2
(45) Date of Patent: Mar. 21, 2006

(54) ARTICULATED BRACELET INCLUDING DECORATIVE LINKS THREADED ONTO A CHAIN

(75) Inventor: Rui Carrola, Fleurier (CH)

(73) Assignee: Comadur S.A., Le Locle (CH)

( * ) Notice: Subject to any disclaimer, the term of this patent is extended or adjusted under 35 U.S.C. 154(b) by 0 days.

(21) Appl. No.: 11/085,128

(22) Filed: Mar. 22, 2005

(65) Prior Publication Data

US 2005/0210857 A1 Sep. 29, 2005

(30) Foreign Application Priority Data

Mar. 23, 2004 (EP) ..... 04006894

(51) Int. Cl.
*A44C 5/02* (2006.01)
*F16G 15/00* (2006.01)

(52) U.S. Cl. ..... 59/80; 59/85; 59/63; 59/4; 59/9

(58) Field of Classification Search ..... 59/78, 59/80, 85, 93; 63/4, 9
See application file for complete search history.

(56) References Cited

U.S. PATENT DOCUMENTS 1,357,139 A * 10/1920 Bayardi ..... 59/80
4,840,044 A * 6/1989 Scholpp ..... 63/4
4,930,304 A * 6/1990 Meister ..... 59/80
5,347,498 A * 9/1994 Loth et al. ..... 59/84
5,365,753 A * 11/1994 Carrola ..... 63/4
6,345,492 B1 * 2/2002 Luscher et al. ..... 59/80
6,714,400 B1 * 3/2004 Guerry et al. ..... 59/80

FOREIGN PATENT DOCUMENTS

CH 684 988 A5 2/1995
EP 549 979 B1 7/1993
EP 1 136 011 A1 9/2001

* cited by examiner

*Primary Examiner*—David Jones
(74) *Attorney, Agent, or Firm*—Sughrue Mion, PLLC

(57) ABSTRACT

The linked bracelet, in particular for a watch, comprises a metal hinged chain passing through a series of ornamental tubular links (4) made of ceramic material, each ornamental link (4) having at least one longitudinal passage (20), in which a metal link and a hinge associated with it are housed and can rest against an inside surface (26) of the base (27) of the ornamental link in the region of the hinge, when the hinge is in a folded position. A front face (23) of each ornamental link (4) has at least one raised section (34) located in the same region of the width of the ornamental link as said inside surface (26) where the hinge or the metal link rests, this raised section being arranged to abut against the opposite front face (24) of the adjacent ornamental link when the hinge is in said folded position. This arrangement balances the vertical force (F) exerted by the chain on the base (27) of the ornamental link at the right place and thus prevents any risk of fracture by transverse bending.

8 Claims, 2 Drawing Sheets

ARTICULATED BRACELET INCLUDING DECORATIVE LINKS THREADED ONTO A CHAIN

This application claims priority from European Patent Application No. 04006894.2 filed Mar. 23, 2004, the entire disclosure of which is incorporated herein by reference.

BACKGROUND OF THE INVENTION

The present invention relates to a linked bracelet, in particular for a watch, comprising a linked chain composed of metal links joined in twos by hinges and a series of ornamental tubular links threaded onto said chain and able to rest longitudinally one against the other at their respective front faces, each ornamental link having at least one longitudinal passage, in which a metal link and a hinge associated with it are housed and can rest against an inside surface of a lower wall of the ornamental link in the region of the hinge, when the hinge is in a folded position. The invention also relates to an ornamental link that may be used in such a bracelet.

Watch bracelets of this type are described in particular in patent publications CH 684 988, EP 549 979 and EP 1 136 011, and their ornamental links are preferably made from a hard ceramic material, and are therefore scratch-resistant and can have an attractive shiny appearance for a great number of years. However, a disadvantage of these materials is that they are somewhat fragile and are less resistant than metal materials to tensile and bending stresses. In some circumstances, the linked chain passing through the tubular ornamental links can exert stresses of this type on some of these can cause one of their walls to break, thus requiring the broken link to be replaced. Incidents of this type are very annoying when top of the range articles are concerned. As bracelets are articles, in which appearance plays a significant role, these links cannot always be reinforced by a significant increase in the thickness of their walls. Therefore, there is a need to remedy this situation by at least partially using other means.

SUMMARY OF THE INVENTION

The present invention is based upon the idea that the above-mentioned fractures of ceramic links can result from parasitic bending stresses produced in a transverse direction by the hinge resting on the base of the link, when the abutment zones of the front surfaces of two successive links are at a relatively large lateral distance from the abutment zone of the hinge, as shall be explained in detail below with reference to the drawings. Therefore, the principle of the solution provided in this invention is to arrange the mutually opposite front faces of the ornamental links in such a way that their abutment zones are positioned as closely as possible to each zone, where the hinge rests on the base of the link.

More particularly, according to a first aspect of the invention a bracelet of the type mentioned above in the introduction is provided, which is characterised in that in its lower section a front face of each ornamental link has at least one raised section located in the same region of the width of the ornamental link as said inside surface where the hinge or the metal link rests, this raised section being arranged to abut against an opposite front face of the adjacent ornamental link when the hinge is in said folded position. Thus, even if said opposite front face is simply flat or slightly curved, the abutment stress between two successive links still occurs in one zone or some well defined zones which are not shifted laterally in relation to the regions of the ornamental link, on which the chain rests. This results in a substantial suppression or reduction of the bending stresses in the transverse direction of the ornamental link.

According to another aspect of the invention, a tubular ornamental link made of ceramic material is provided for a bracelet comprising at least one longitudinal passage, in which a flexible or linked connection is housed and can rest against an inside surface of a lower wall of the ornamental link, characterised in that in a lower section of at least one of its front faces, it has at least one raised section located in the same region of the width of the ornamental link as said inside surface where the connection abuts, said lower section of the front face being inclined towards the inside of the link in relation to a plane perpendicular to the direction of said longitudinal passage.

Other characteristics and advantages of this invention will be seen in the description of a preferred embodiment provided below by way of non-restrictive example with reference to the attached drawings.

DETAILED DESCRIPTION OF AN EMBODIMENT OF THE INVENTION

Figure 1:
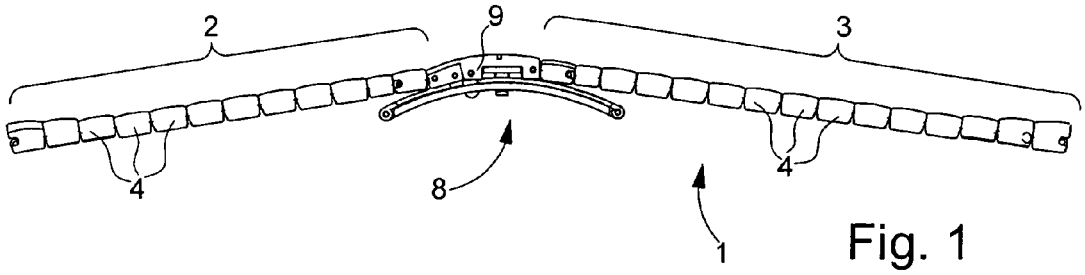
FIG. 1 is a schematic side view of a watch bracelet, in which the present invention is applied.
Figure 2:
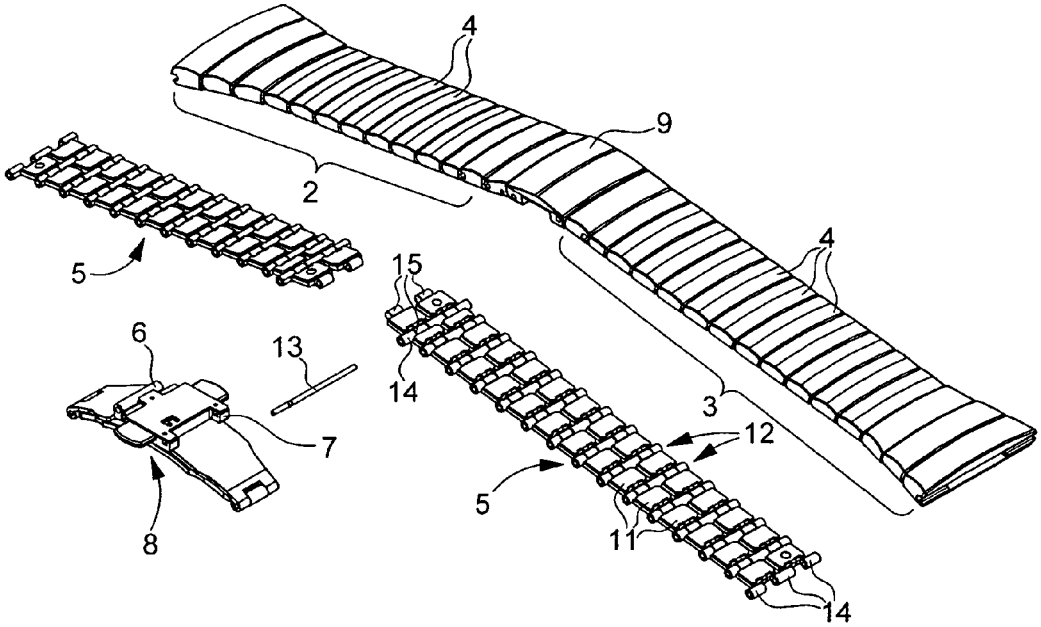
FIG. 2 is an exploded perspective view of the bracelet of FIG. 1 in particular showing two series of tubular ornamental links and two linked metal chains, on which the ornamental links are threaded.

The watch bracelet 1 shown in FIGS. 1 and 2 has, in a known manner, two bracelet strands 2 and 3, each comprising a series of tubular ornamental links 4 and a metal chain 5, on which the ornamental links 4 are threaded, these preferably being made from a hard ceramic material. One end of each chain 5 is attached to a connecting element 6, 7 of a fold-out clasp 8, which is provided with its own ornamental element 9, while its other end is intended to be attached to the watch case. Each chain 5 is composed of a series of metal links 11, each of which is joined to the following one by a hinge 12 with a transverse axis, this hinge having a pin 13 inserted through respective rings 14 and 15 of adjacent links 11. Each ornamental link 4 contains one of the metal links 11 of the chain 5 and one of the hinges 12. Except for the specific features of the present invention, the general structure of the bracelet 1 can be the same as that described in the patent application EP 1 136 011, which is incorporated herein by reference and to which the reader may refer for more details in this regard.

Figure 3:
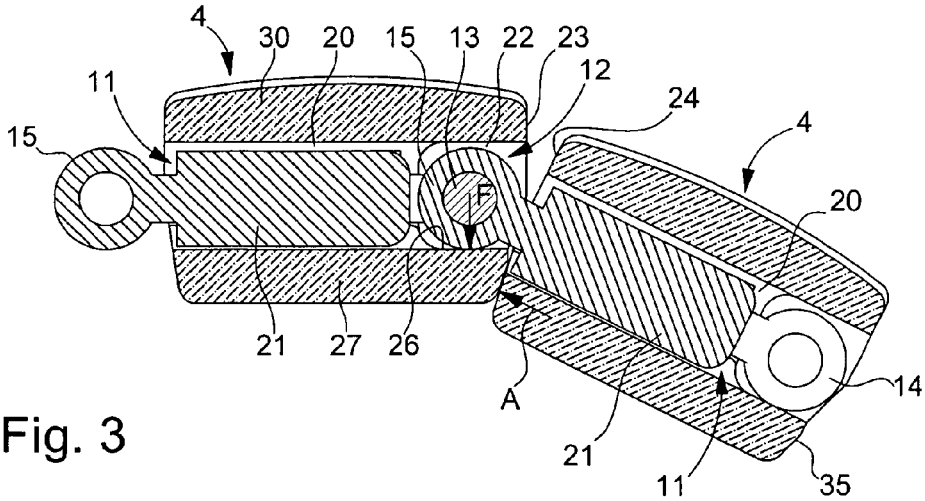
FIG. 3 is a schematic enlarged view in longitudinal section showing two adjacent ornamental links and the section of chain, which they contain, in a folded position of the hinge contained in one of the links.

As will be seen in more detail in FIG. 3, each ornamental link 4 has a longitudinal passage 20, in which are located the central flat section 21 of one of the metal links 11 of the chain and the hinge 12 connecting this metal link to the following one. In the example shown here, each metal link 11 has two flat sections 21 positioned side by side and separated by a space, as in the configurations described in the patent publications CH 684 988 and EP 1 136 011, but it should be understood that the present invention may be used in bracelets using different chains, provided that they have at least one hinge housed inside an ornamental link. So that it remains invisible to the outside, the hinge 12 is housed in a space 22 at the entry to the passage 20, this space opening onto the first front face 23 of the ornamental link 4. In other words, looking at FIG. 3 the chain link 11 located in the ornamental link 4 on the right also extends through its ring 15 into the entrance space 22 of the ornamental link on the left.

The bracelet can have a curved configuration as a result of the angular clearance of the hinges 12 of the chain. This angular clearance is limited to the folded position shown in FIG. 3, where the lower section of the front face 23 of the ornamental link on the left rests against the lower section of the opposite front face 24 of the ornamental link on the right. Consequently, the right link exerts a force shown by arrow A on the lower section of the front face 23 of the other ornamental link 4. This force is balanced by an equivalent tension in the chain. Because of the folded position of the hinge 12, this tension causes the hinge 12 to rest on the inside surface 26 of the passage 20 with a force F essentially perpendicular to the abutment surface 26.

In the ornamental links formed according to the prior art, it is seen that these stresses sometimes cause the base 27 of one of the ornamental links 4 to break open, even though the forces in question are not very high. In fact, some ceramic links withstand these stresses perfectly, while others break. A thorough study of this phenomenon has shown that this is attributable to irregularities in shape of the front faces 23 and 24 of the ornamental links 4 as a result of deformations associated with sintering. If longitudinal abutment forces A are exerted, for example, close to the side faces of the links 4, i.e. close to the flanks of the bracelet, the vertical abutment force F acting on the central section of the base 27 exerts a transverse bending stress F on this, which can cause the ceramic to fracture. This conclusion has been confirmed by the fact that the number of fractures of this type is greatly reduced if the sections concerned of the front surfaces 23 and 24 are precision-ground so that they can abut against one another over their entire width. However, such machining of each ornamental link greatly increases the cost.

Figure 4:
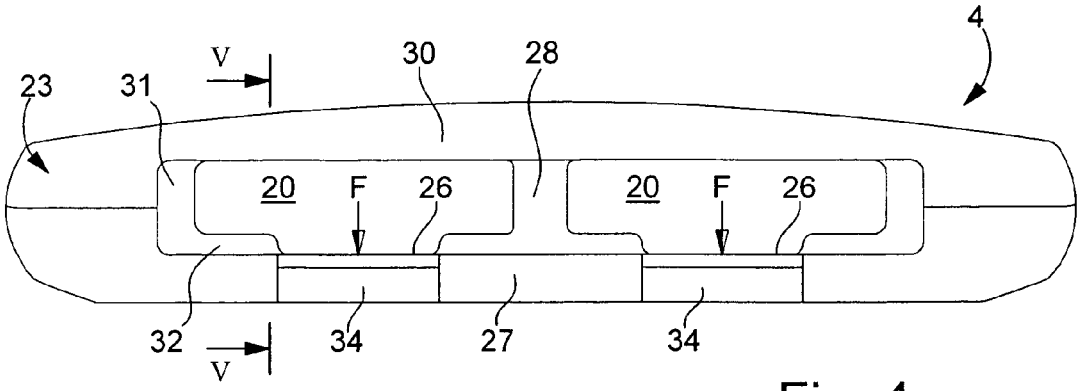
FIG. 4 is a front view of one of the ornamental links of the bracelet.
Figure 5:
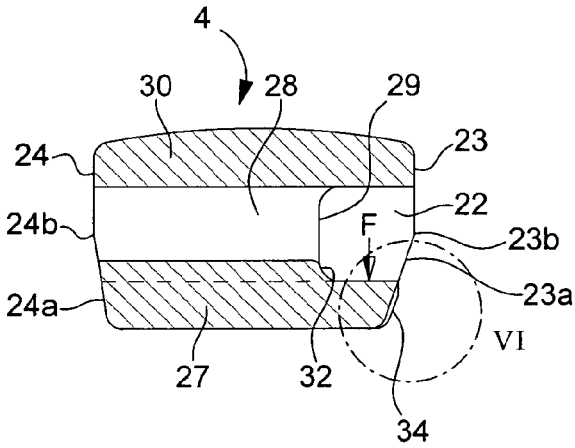
FIG. 5 is a view in longitudinal section taken along line V—V of FIG. 4.
Figure 6:
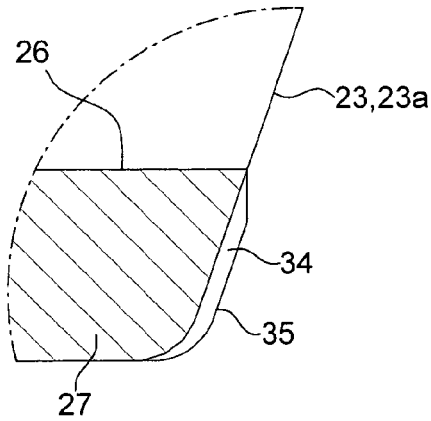
FIG. 6 is an enlarged view of detail VI in FIG. 5.

FIGS. 4 to 6 show an example of an arrangement of the ornamental link 4, which can avoid the disadvantages outlined above. This link is a single-piece element made of ceramic material produced in a known manner from moulding and sintering followed by polishing, if necessary. To allow the double chain 5 to pass through, the tubular shape of the link has two longitudinal passages 20 here separated by a central partition 28, which joins the base 27 of the link to the upper wall 30 and which has an end 29 at the base of the entrance space 22 to allow the necessary space for the hinge. On either side of each passage 20, the base of the space also has side shoulders 31 and lower shoulders 32, against which the hinge can rest in longitudinal direction.

The lower section 23*a*, 24*a* of each front face 23, 24 has a profile inclined towards the inside of the link in relation to a plane perpendicular to the direction of the longitudinal passage 20 from a horizontal line 23*b*, 24*b* located at the level of the axis of the hinge to allow the hinge to fold as far as an end angle without causing substantial tension in the chain and without the chain becoming visible from above. On its lower section 23*a*, the front face 23 has two raised sections 34 of low thickness (less than 0.5 mm, e.g. 0.08 mm) each located below the centre of one of the passages 20, i.e. in the same regions of the width of the link 4 as the two inside surfaces 26 described above. In this example, each raised section 34 has a width essentially equal to that of the ring of the chain 5 resting on the surface 26 above it, but it could, of course, be slightly wider or narrower. This ring can be provided with an outside diameter that is slightly larger than that of the rings lying adjacent to it in order to properly position the abutment of the chain in said regions of the width of the link 4. For the abutment of the adjacent ornamental link on a certain width, each raised section 34 preferably has a prism shape, which has an inclined flat surface 35 intended to rest against the essentially flat lower section 24*a* of the adjacent link. Thus, the abutment force shown by arrow A in FIG. 3 will be distributed over the width of each raised section and will have a rising vertical component, which balances the descending vertical force F precisely in each region of the width of the link 4 where the force F is applied. Tests have shown that this enables the fractures mentioned in the introduction to be prevented.

Although the example described here refers to two raised sections on one of the front faces of each ornamental link, a person skilled in the art will understand that the invention also extends to other numbers and/or arrangements of the raised sections, in particular depending on the width and configuration of the links of the chain and the ornamental links. In particular, an out-of-centre raised section can be provided on each front surface 23 and 24 to rest against a flat zone of the front surface of the adjacent link. It should also be noted that the abutment of the chain on the lower surface 26 of the ornamental link does not necessarily occur via the hinge 12, but can also occur via another section of the metal link 11.

It should also be noted that ornamental links according to the invention can be used with a flexible connection instead of the hinged connection formed by the chain mentioned here.

What is claimed is:

1. A linked bracelet comprising a linked chain composed of metal links joined by associated hinges and a series of ornamental links of tubular shape being mounted onto said chain, said tubular shape including a lower wall and an upper wall, each ornamental link having at least one longitudinal passage which extends in an axial direction between two end faces of the ornamental link and in which one of said metal links and an associated hinge are housed such that either said hinge or a portion of the metal link can rest against at least one inside surface of said lower wall when the hinge is in a folded position, respective opposite end faces of adjacent ones of the ornamental links being able to rest against each other, wherein at least one end of said lower wall of each ornamental link, forming a lower section of one of said end faces, has at least one raised section located in vertical alignment with said inside surface, said raised section being arranged to abut against the opposite end face of the adjacent ornamental link when the hinge is in said folded position.

2. The bracelet according to claim 1, wherein the lower section of said one end face is inclined towards the other end face of the ornamental link in relation to a plane perpendicular to said axial direction.

3. The bracelet according to claim 1, wherein the ornamental link comprises a space associated with said at least one passage and arranged to receive the hinge.

4. The bracelet according to claim 1, wherein two similar raised sections are juxtaposed laterally on the lower section of said one end face.

5. The bracelet according to claim 1, wherein a lower section of said opposite end face is essentially flat.

6. The bracelet according to claim 1, wherein the ornamental links are made of ceramic material.

7. A tubular ornamental link made of ceramic material for a bracelet, having a lower wall, an upper wall and a longitudinal passage that extend in an axial direction between two end faces of the ornamental link, said longitudinal passage being arranged for housing a flexible or linked connection of the bracelet, said flexible or linked connection being able to rest onto at least one inside surface of said lower wall within said longitudinal passage, wherein at least one end of said lower wall, forming a lower section of one of said end faces, has at least one raised section located in vertical alignment with said inside surface, said lower section of said end face being inclined towards the other end face of the ornamental link in relation to a plane perpendicular to said axial direction.

8. The tubular ornamental link of claim 7, wherein a lower section of the other end face is essentially flat.

* * * * *